US009151154B2

(12) United States Patent
Meadows

(10) Patent No.: US 9,151,154 B2
(45) Date of Patent: Oct. 6, 2015

(54) FLOW THROUGH TEST CELL

(71) Applicant: Halliburton Energy Services, Inc., Houston, TX (US)

(72) Inventor: David Leon Meadows, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 314 days.

(21) Appl. No.: 13/907,094

(22) Filed: May 31, 2013

(65) Prior Publication Data

US 2014/0352421 A1 Dec. 4, 2014

(51) Int. Cl.

| | |
|---|---|
| ***E21B 49/10*** | (2006.01) |
| ***E21B 49/02*** | (2006.01) |
| ***E21B 49/08*** | (2006.01) |

(52) U.S. Cl.

CPC ..... *E21B 49/02* (2013.01); *E21B 49/08* (2013.01)

(58) Field of Classification Search

None

See application file for complete search history.

(56) References Cited

U.S. PATENT DOCUMENTS

| | | | | |
|---|---|---|---|---|
| 2,864,253 | A | 12/1958 | Lenton | |
| 3,975,950 | A | 8/1976 | Erdei | |
| 5,677,495 | A | 10/1997 | Johnson et al. | |
| 5,902,936 | A | 5/1999 | Serra-Tosio et al. | |
| 7,549,320 | B2 | 6/2009 | Funkhouser et al. | |
| 7,621,186 | B2 | 11/2009 | Heathman et al. | |
| 8,322,198 | B2 | 12/2012 | Iverson et al. | |
| 2007/0056383 | A1* | 3/2007 | Deeg | 73/788 |
| 2011/0094295 | A1 | 4/2011 | Meadows et al. | |
| 2013/0340505 | A1* | 12/2013 | Go Boncan et al. | 73/38 |
| 2014/0007695 | A1* | 1/2014 | Darbe et al. | 73/803 |
| 2014/0260560 | A1* | 9/2014 | Zamora | 73/54.28 |
| 2015/0024975 | A1* | 1/2015 | Wagle et al. | 507/117 |

FOREIGN PATENT DOCUMENTS

EP 0566394 A1 10/1993

OTHER PUBLICATIONS

Alexeev, A. D., et al., "The Effect of Stress State Factor on Fracture of Sandstones Under True Triaxial Loading," Int J Fract, 2008, pp. 1-10, vol. 149, Springer.

Bhargava, Peeyush, et al., "Polyaxial Test Cell for Large Scale Testing of Rocks," European Sand Management Conference, Mar. 10, 2010, pp. 1-7, Exxon Mobil Upstream Research.

Smart, B.G.D., et al., "A Rock Test Cell with True Triaxial Capability," Geotechnical and Geological Engineering, 1999, pp. 157-176, vol. 17, Kluwer Academic Publishers, Netherlands.

Zeuch, D. H., et al., "Mechanical Properties and Shear Failure Surfaces for Two Alumina Powders in Triaxial Compression," Journal of Materials Science, 2001, pp. 2911-2924, vol. 36, Kluwer Academic Publishers.

* cited by examiner

*Primary Examiner* — Andre Allen

(74) *Attorney, Agent, or Firm* — Craig W. Roddy; Baker Botts L.L.P.

(57) ABSTRACT

An apparatus for preparing and testing a sample of a subterranean formation, the apparatus comprising a pressure cell defining an interior volume, the pressure cell comprising a first end member comprising a channel formed therein, a second end member, a wall member positioned between the first end member and the second end member, and a sample cell positioned within the interior volume of the pressure cell, wherein the channel of the first end member fluidly connects with a first point external of the pressure cell, with a second point external of the pressure cell, and with the sample cell.

20 Claims, 5 Drawing Sheets

FLOW THROUGH TEST CELL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes formed in a subterranean formation which contains a hydrocarbon, and wellbore operations and/or hydrocarbon production may be conducted via the wellbores. Mechanical properties of a subterranean formation can affect the design of a wellbore; moreover, certain properties may be indicative of a subterranean formation which can shift, move, or migrate under certain conditions, inhibiting wellbore operations and/or hydrocarbon production.

As such, it can be desirable to obtain and test a sample of the subterranean formation in which a wellbore is to be drilled and/or when problems in the subterranean formation have occurred, are suspected, or are known. In some instances, samples of subterranean formations are taken and subsequently evaluated to determine one or more properties of the subterranean formation. For example, a sample may be obtained by drilling into the subterranean formation with a core drill as known in the art. After drilling for the sample, the core drill may be raised to the surface, where the sample is removed from the core drill for testing and evaluation for various properties, including mechanical properties. By testing a sample of a subterranean formation, characteristics of the subterranean formation may be better understood.

SUMMARY

Disclosed herein is an apparatus for preparing and testing a sample of a subterranean formation, the apparatus comprising a pressure cell defining an interior volume, the pressure cell comprising a first end member comprising a channel formed therein, a second end member, a wall member positioned between the first end member and the second end member, and a sample cell positioned within the interior volume of the pressure cell, wherein the channel of the first end member fluidly connects with a first point external of the pressure cell, with a second point external of the pressure cell, and with the sample cell.

Also disclosed herein is a system for preparing and testing a subterranean sample, the system comprising an apparatus comprising a pressure cell defining an interior volume, wherein the pressure cell comprises a channel formed therein, and a sample cell positioned within the interior volume of the pressure cell, wherein the channel of the pressure cell fluidly communicates with a first point external of the pressure cell, with a second point external of the pressure cell, and with the sample cell, a sample of a subterranean formation placed within the sample cell, and a resin placed within the sample cell.

Further disclosed herein is a method comprising providing an apparatus comprising a pressure cell defining an interior volume, and a sample cell positioned within the interior volume of the pressure cell, wherein the pressure cell comprises a channel formed therein, wherein the channel of the pressure cell fluidly communicates with a first point external of the pressure cell, with a second point external of the pressure cell, and with the sample cell, loading a sample of a subterranean formation into the sample cell, providing a stabilizing product, flowing a sample of the stabilizing product into the sample cell via the channel formed in the pressure cell, curing the stabilizing product in-situ of the sample cell, and testing the stabilized sample in-situ of the sample cell.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
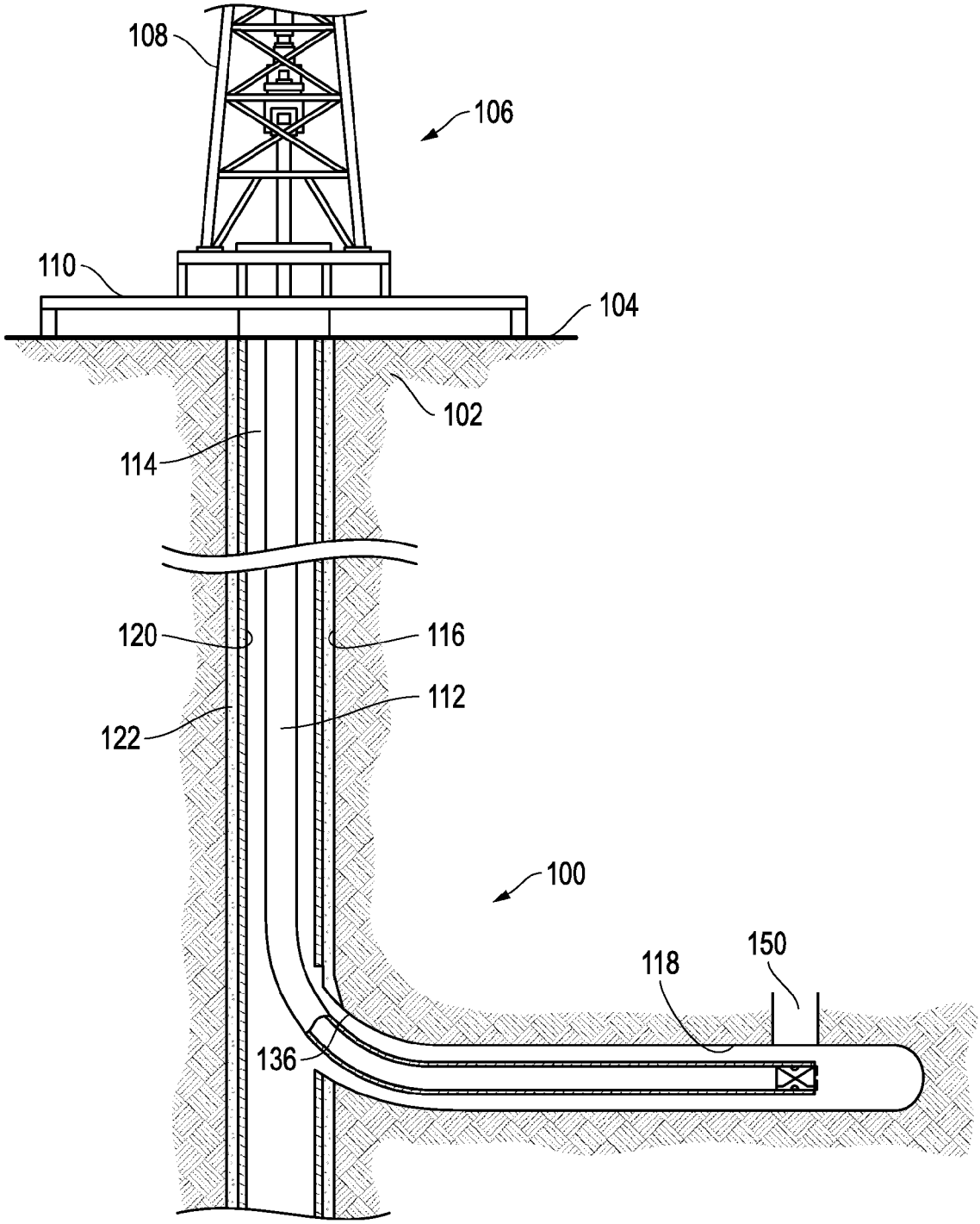
FIG. 1 is a partial cut-away view of an embodiment of a wellbore environment extending in a subterranean formation.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Terms of relative orientation such as "up," "down," "vertical," "horizontal," "upper," "lower," "above," "below," "top," and "bottom" are used to describe relation of elements of the embodiments described for the figures. Unless specified, use of such terms does not require the embodiments to be oriented as shown in the figures. For example, the apparatus 200 of FIG. 2 is illustrated vertically; however, in embodiments, the apparatus 200 may be operated in various orientations, e.g., vertically, horizontally, at an angle, upside down, etc.

Unless otherwise specified, use of the term "subterranean formation" shall be construed as encompassing both areas below exposed earth and areas below earth covered by water such as ocean or fresh water.

The term "valve" refers to any type of valve suitable for use with the disclosed embodiments, such as a ball valve, a needle valve, a check valve, solenoid valve, pneumatic valve, or combinations thereof.

The term "line" refers to a tubing suitable for use with the disclosed embodiments, such as a stainless steel tubing.

Disclosed herein are embodiments of an apparatus for testing samples of a subterranean formation, as well as systems and methods that may utilize the same. In the disclosed embodiments, samples of a subterranean formation can be tested at various conditions (e.g., at temperatures and pressures existing in the subterranean formation 102, at wellbore operating conditions, at other conditions, or combinations thereof). Additionally, the sample may be prepared for testing by treating (e.g., adding a stabilizing product such as a resin to the sample), and then the sample (e.g., in stabilized form) may be tested in-situ without disassembly of the apparatus or removal of the resin and sample therefrom before testing.

A subterranean formation in the context of a wellbore environment will now be discussed. Referring to FIG. 1, an embodiment of a wellbore environment 100 extending in a subterranean formation 102 is shown. As depicted, the wellbore environment 100 comprises a rig 106 (e.g., a drilling, completion, or workover rig) that is positioned on the earth's surface 104 and extends over and around a wellbore 114 that penetrates the subterranean formation 102 for the purpose of recovering fluids, such as hydrocarbons and/or water.

The wellbore 114 may be drilled into the subterranean formation 102 using any suitable drilling technique. The wellbore 114 may extend substantially vertically away from the earth's surface 104 over a vertical wellbore portion 116, deviate from vertical relative to the earth's surface 104 over a deviated wellbore portion 136, and transition to a horizontal wellbore portion 118. In alternative wellbore environments, all or portions of a wellbore may be vertical, deviated at any suitable angle, horizontal, and/or curved.

The rig 106 may be placed over the wellbore 114. The rig 106 may comprise a derrick 108 with a rig floor 110 through which, in servicing operations, a tubing or work string 112 (e.g., cable, wireline, E-line, Z-line, jointed pipe, coiled tubing, casing, liner, drill string, tool string, segmented tubing string, a jointed tubing string, combinations thereof, etc.) extends downward from the rig 106 into the wellbore 114 and defines an annulus between the work string 112 and the wellbore 114. While the wellbore environment 100 depicted in FIG. 1 shows a stationary rig 106 with a land-based wellbore 114, in alternative embodiments, mobile workover rigs, wellbore servicing units (such as coiled tubing units), and the like may be used. It should be understood that the wellbore environment 100 may alternatively comprise an offshore wellbore environment.

At least a portion of the wellbore 114 is lined with a casing 120 that is secured into position against the subterranean formation 102 in a conventional manner, for example, using cement 122. In alternative operating environments, a horizontal wellbore portion 118 may be cased and cemented and/or portions of the wellbore may be uncased.

The subterranean formation 102 may comprise a material such as a rock, sand, or both, which has an undesirable property, such as a material which shifts, moves, or migrates in certain circumstances e.g., during wellbore operations or hydrocarbon production. For example, wellbore operations or hydrocarbon production may be inhibited by a subterranean formation 102 which contains a material that shifts, moves or migrates, which compromises the integrity of the wellbore 114 and/or permeability of the subterranean formation 102, and which affects operations and/or hydrocarbon production (e.g., in zone 150 of FIG. 1). In such cases, a sample of the subterranean formation 102 may be obtained for preparation and/or testing thereof to understand and/or improve properties of the subterranean formation 102. A sample of the subterranean formation 102 may be obtained at any stage, e.g., before, during, or after drilling, fracturing, completion, production, or combinations thereof.

A sample of the subterranean formation 102 may be tested for one or more certain properties (e.g., composition, density, compression strength, tensile strength, permeability, etc.). Additionally, the sample of the subterranean formation 102 may be combined with a stabilizing product (e.g., a resin) to modify a property of the material of the subterranean formation 102. For example, a resin may be added to the material sample and then tested in the disclosed embodiments for the effect on compression strength and permeability. In embodiments where a suitable stabilizing product has been found by testing with the disclosed embodiments, the stabilizing product may be placed into the subterranean formation 102. For example, a suitable stabilizing product may be injected to zone 150 in subterranean formation 102 via tubular or work string 112 extending in wellbore 114.

Figure 2A:
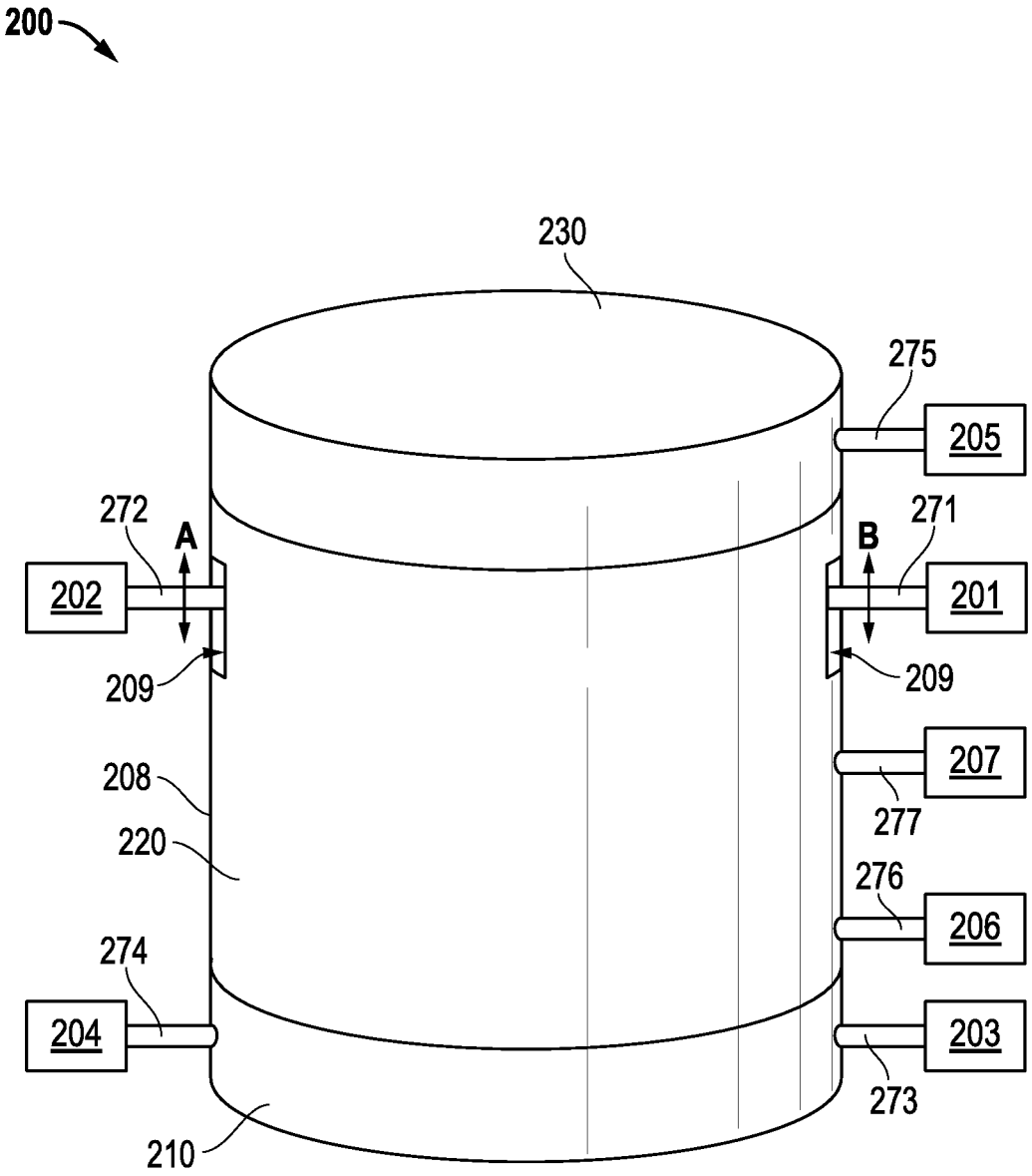
FIG. 2A is a perspective view of an embodiment of the disclosed apparatus.

FIG. 2A shows a perspective view of an embodiment of the disclosed apparatus 200. The apparatus 200 may be utilized to prepare and to test a sample of a subterranean formation 102. As can be seen, the apparatus 200 may comprise a cylindrical shape. In an alternative embodiment, the apparatus 200 may comprise another shape, such as a spherical shape, a cubic shape, a cuboid shape, or other polyhedron shape.

It can be seen the apparatus 200 may comprise a pressure cell 208. The pressure cell 208 may comprise a first end member 210, a second end member 230, and a body or wall member 220 positioned between the first end member 210 and the second end member 230.

The apparatus 200 may fluidly connect to various points external of the pressure cell 208. In embodiments, the points external of the pressure cell 208 may comprise a point 201 external of the pressure cell 208, a point 202 external of the pressure cell 208, a point 203 external of the pressure cell 208, a point 204 external of the pressure cell 208, a point 205 external of the pressure cell 208, a point 206 external of the pressure cell 208, a point 207 external of the pressure cell 208, or combinations thereof.

In embodiments, line 271 may fluidly connect the apparatus 200 to the point 201 external of the pressure cell 208, line 272 may fluidly connect the apparatus 200 to the point 202 external of the pressure cell 208, line 273 may fluidly connect the pressure cell 208 to the point 203 external of the pressure cell 208, line 274 may fluidly connect the pressure cell 208 to the point 204 external of the pressure cell 208, line 275 may fluidly connect the pressure cell 208 to the point 205 external of the pressure cell 208, line 276 may fluidly connect the pressure cell 208 to the point 206 external of the pressure cell 208, line 277 may fluidly connect the pressure cell 208 to the point 207 external of the pressure cell 208, or combinations thereof.

Figure 4:
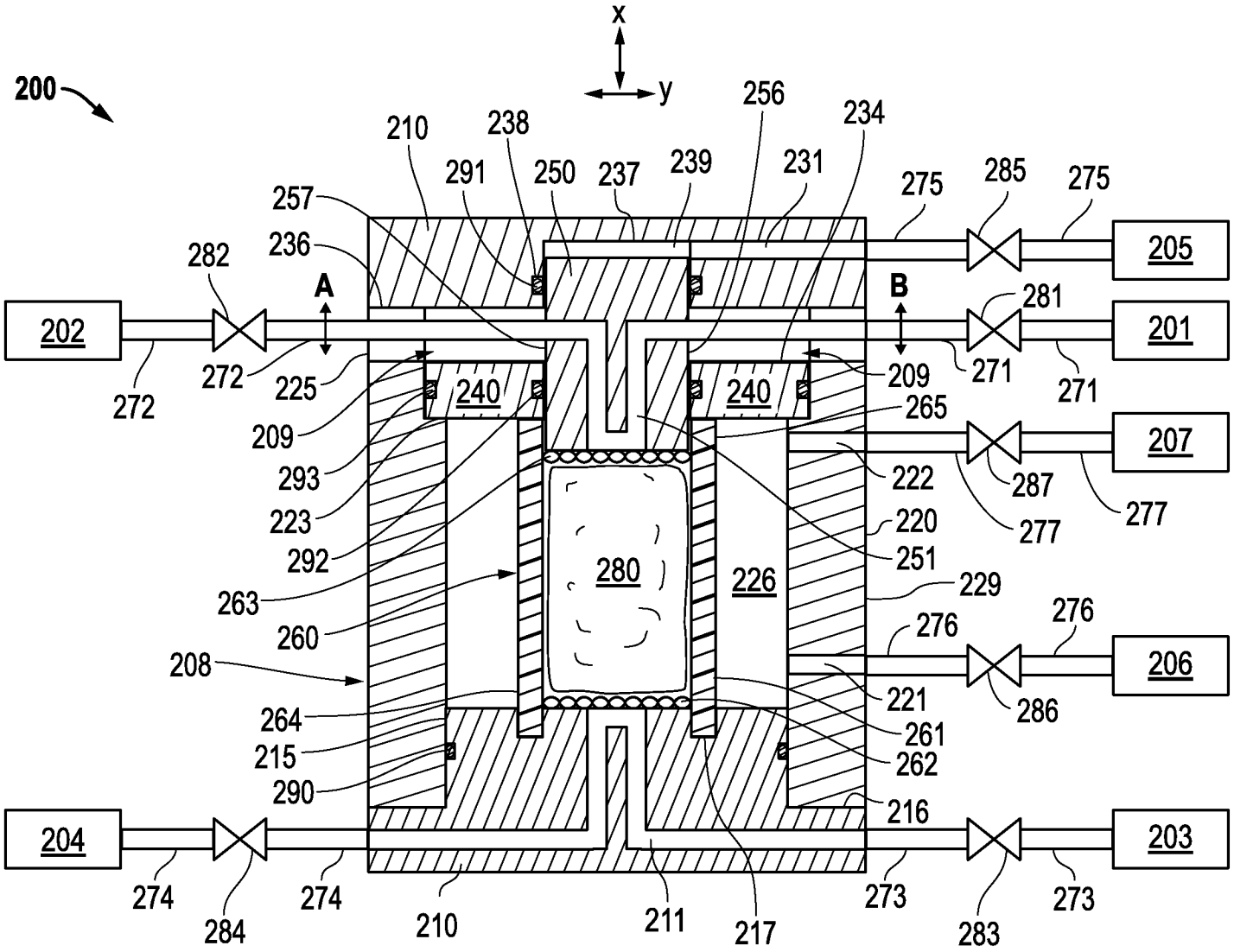
FIG. 4 shows a cross-section view of an embodiment of the disclosed system.

In embodiments, one or more of the lines 271, 272, 273, 274, 275, 276, 277 may comprise a valve (discussed in the description for FIG. 4). In embodiments, one or more of the points 201, 202, 203, 204, 205, 206, 207 external of the pressure cell 208 may comprise a source for a fluid, e.g., a confining fluid (e.g., water), a hydraulic fluid, a stabilizing product (e.g., a resin, a conformance sealant, an acid, or combinations thereof), a gas (e.g., air), or combinations thereof. In additional or alternative embodiments, one or more of the points 201, 202, 203, 204, 205, 206, 207 external of the pressure cell 208 may comprise a pump to pump a fluid to and/or from the apparatus 200. In additional or alternative embodiments, one or more of the points 201, 202, 203, 204 external of the pressure cell 208 may comprise a flow measurement instrument to measure the flow of a fluid to and/or from the one or more points 201, 202, 203, 204. In additional or alternative embodiments, one or more of the points 201, 202, 203, 204, 205, 206, 207 external of the pressure cell 208 may comprise an exit for a fluid from the apparatus 200.

Apertures 209 may be formed in the apparatus 200 through which lines 271 and 272 may extend. When a sample of the subterranean formation 102 is tested (e.g., with a stabilizing product added thereto) in the apparatus 200, the lines 271 and 272 may move with the piston 250 in the direction of the arrows A and B shown in FIG. 2 (e.g., vertically in the orientation shown in FIG. 2). The apertures 209 of the apparatus 200 may be sized to accommodate for lines 271 and 272 to extend therethrough and to accommodate for the movement of the lines 271 and 272 in the direction of the arrows shown in FIG. 2. The apertures 209 may be fluidly isolated from an interior volume (described in FIG. 4 below) of the pressure cell 208 and from the hydraulic volume (e.g., hydraulic volume 239 of FIG. 4) used to actuate the piston (shown in FIGS. 2B, 3, and 4) of the apparatus 200 (e.g., via seals described hereinbelow).

In embodiments, fluid connections between any components (e.g., lines, valves, pumps, measurement instruments, etc.) generally may be made using compression-type fittings. In embodiments, the lines 271, 272, 273, 274, 275, 276, 277 and equipment included in said lines (e.g., valves shown in FIG. 4) may comprise an inner diameter of about ⅛" to about ½". In embodiments, the apparatus 200 shown in FIG. 2 may comprise a width (e.g., a diameter) of from about 2" to about 6" and a height of about 3" to about 12". In embodiments, the apparatus 200 may be utilized with any number of other like apparatus arranged for preparation and testing of multiple samples of subterranean formation 102.

Figure 2B:
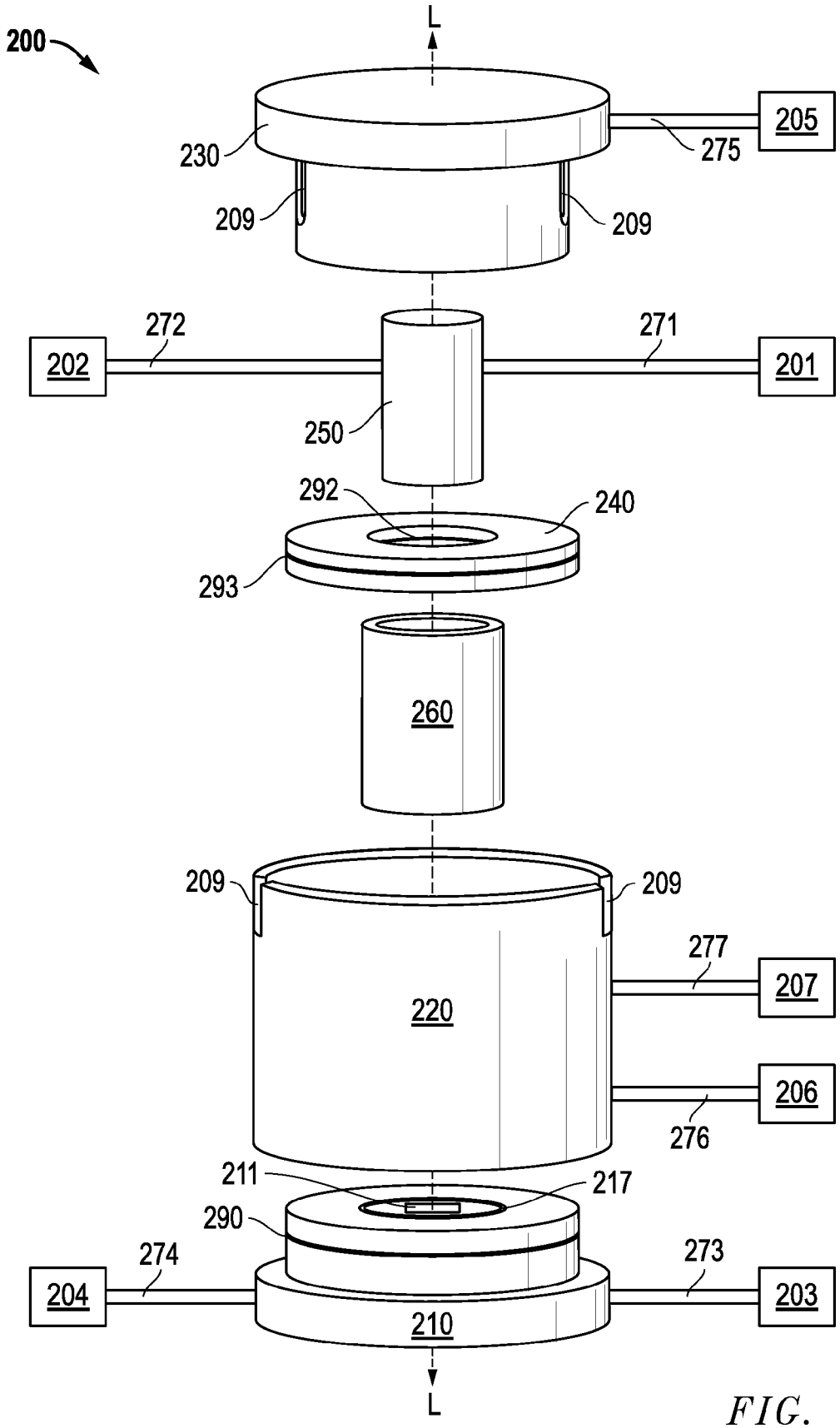
FIG. 2B is an exploded perspective view of an embodiment of the disclosed apparatus.

FIG. 2B shows an exploded perspective view of an embodiment of the disclosed apparatus 200. As can be seen, the pressure cell 208 may comprise the first end member 210, the second end member 230, a ring member 240, and the wall member 220. The apparatus 200 may further comprise a sample cell 260 and a piston 250. The first member 210, the wall member 220, the second member 230, the ring member 240, the piston 250, the sample cell 260, or combinations thereof may share a common longitudinal axis L.

The apertures 209 of the apparatus 200 can be seen as formed in the second end member 230 and in the wall member 220.

The first end member 210, the second end member 230, the ring member 240, the wall member 220, or combinations thereof may define an interior volume (discussed in more detail for FIG. 4) in which the sample cell 260 is positioned. The sample cell 260 may occupy a portion of the interior volume of the pressure cell 208 such that an annular space (discussed for and shown in FIG. 4) is defined between the sample cell 260 and the wall member 220 of the pressure cell 208 (this configuration is described below and shown in FIG. 4).

A portion of the sample cell 260 may fit in a groove 217 formed in the first end member 210, and a channel 211 formed in the first end member 210 may fluidly connect or open to the interior of the sample cell 260 when the sample cell 260 is placed in the groove 217. The sample cell 260 may abut the ring member 240 when the apparatus 200 is assembled (described in more detail in FIG. 4). As described in more detail for FIG. 4, a sample of subterranean formation 102 may be placed in the sample cell 260 for preparation and/or testing.

The piston 250 may fit partially within the second end member 230 and may extend through the ring member 240 into the interior (e.g., a sample chamber) of the sample cell 260. Lines 271 and 272 may fluidly connect with a channel formed in the piston 250.

Various seals (e.g., seals 290, 292, and 293) may be used to provide fluid-tight connections between the components apparatus 200, and such seals are discussed in more detail hereinbelow.

Figure 3:
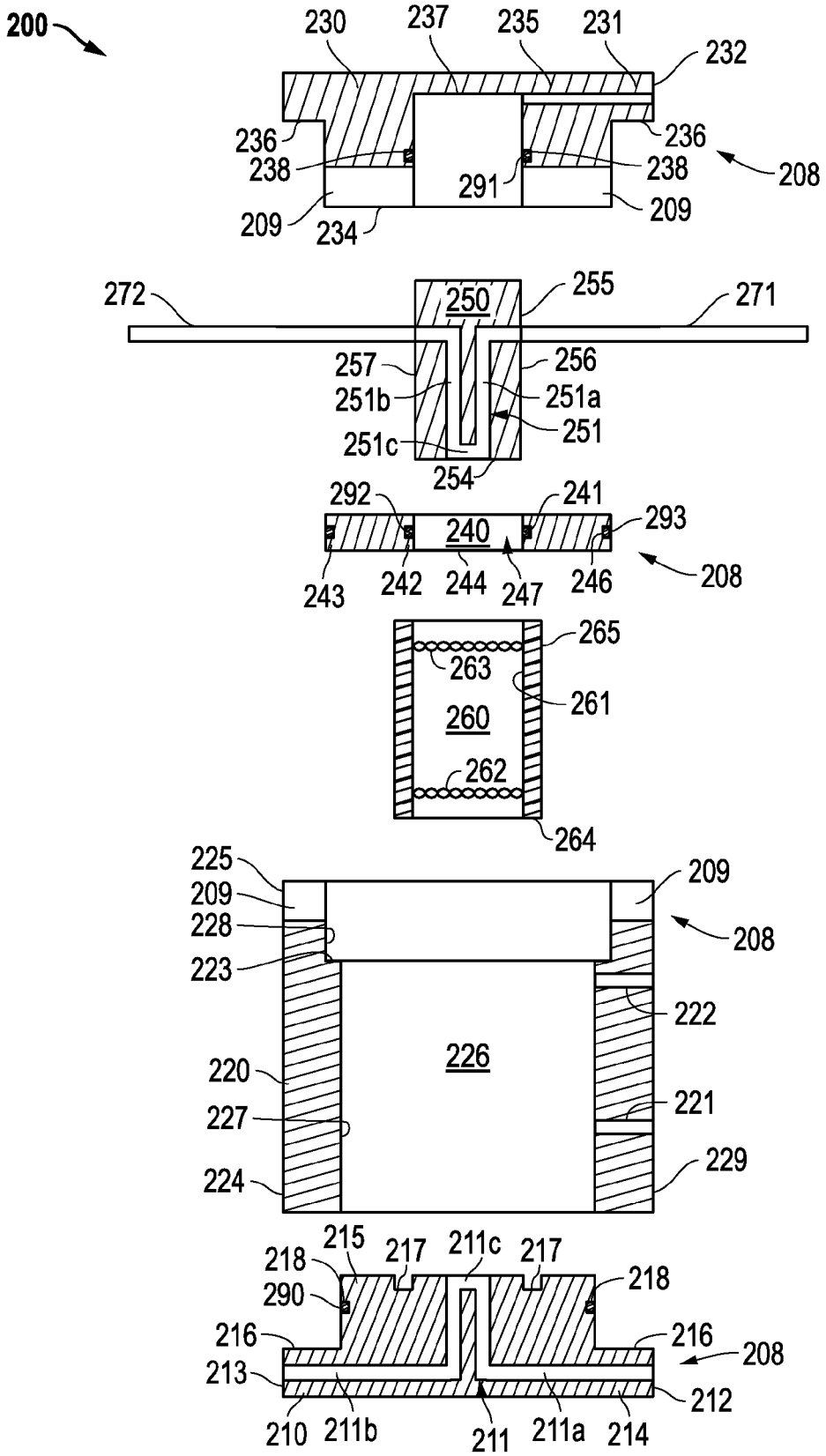
FIG. 3 is a cross-section view of the exploded apparatus shown in FIG. 2B.

FIG. 3 shows a cross-section view of the exploded apparatus 200 shown in FIG. 2B. It can be seen the apparatus 200 may comprise a pressure cell 208, a sample cell 260 positioned within the pressure cell 208, and a piston 250 which can be at least partially received in the second end member 230.

As described for FIGS. 2A and 2B, FIG. 3 shows the pressure cell 208 may comprise a first end member 210, a second end member 230, a wall member 220 positioned between the first end member 210 and the second end member 230, and a ring member 240 positioned between the second end member 230 and the wall member 220.

In embodiments, the first end member 210 may comprise a channel 211 formed therein, a shoulder 216 to receive the end 224 of the wall member 220, and a groove 217 to receive the end 262 of the sample cell 260.

The channel 211 may comprise a first portion 211*a*, a second portion 211*b*, and a third portion 211*c*. In embodiments, the channel 211 may fluidly connect to three different exterior locations of the first end member 210. For example, the first portion 211*a* of the channel 211 may fluidly connect to a side 212 of the first end member 210; alternatively, to the end 214 of the first end member 210. The second portion 211*b* of the channel 211 may fluidly connect to the side 213 of the first end member 210 (e.g., side 213 being opposite where the first portion 211*a* fluidly connects to side 212); alternatively, to the end 214 of the first end member 210. In embodiments, the first portion 211*a* of the channel 211 may fluidly connect to a port formed in the side 212, end 214, or both. In embodiments, the second portion 211*b* of the channel 211 may fluidly connect to a port formed in the side 213, end 214, or both. The port(s) can be configured to receive a fitting for tubing lines (e.g., lines 273 and 274 of FIGS. 2A and 2B) which convey a fluid to and/or from a point (e.g., points 203 and 204 of FIGS. 2A and 2B) external of the pressure vessel 208. The third portion 211*c* of the channel 211 may fluidly connect to end 215 of the first end member 210. Additionally, the third portion 211*c* may fluidly connect the first portion 211*a* and the second portion 211*b* to one another.

In embodiments, the first portion 211*a* of channel 211 may fluidly connect to side 212 of the first end member 210, and second portion 211*b* of channel 211 may fluidly connect to side 213, where the side 213 is opposite of side 212. In alternative embodiments, the first portion 211*a* of channel 211 may fluidly connect to side 212 of the first end member 210, and second portion 211*b* of channel 211 may fluidly connect to side 213, where the side 213 is not opposite of side 212 (e.g., portions 211*a* and 211*b* are next to one another, spaced at an interval (e.g., 45° or 90°, etc.)).

In FIG. 3, first portion 211*a* and second portion 211*b* of the channel 211 formed in the first end member 210 are shown with 90° bends; however, it is contemplated the channel 211 may have other configurations within first end member 210, such as one or more bend at other angles (e.g., 45°), a curve, or combinations thereof.

In an embodiment, the channel 211 may be used to provide and/or remove a fluid (e.g., air, water, stabilizing product, or combinations thereof) to the sample volume of the sample cell 260. In an additional or alternative embodiment, the channel 211 may be used to provide, maintain, and/or remove a pressure (e.g., 0 psi, a pressure exerted by the piston 250, etc.) to a sample in the sample cell 260. In an embodiment, the channel 211 may be used to flush a material (e.g., sample debris, stabilizing product, etc.) out of the sample cell 260 and/or channel 211.

The shoulder 216 of the first end member 210 may be configured to receive the end 224 of the wall member 220, for example, such that end 215 of the first end member 220 extends within the wall member 220. As seen in FIG. 3, the shoulder 216 may comprise an L-shape contour. In an embodiment, the contour of the shoulder 216 is such that end 214 of the first end member 210 is wider (e.g., has a larger diameter) than end 215 of the first end member 210. A seal groove 218 may be formed in the shoulder 216 to receive a seal 290 (e.g., an O-ring) which provides a fluid-tight seal between the first end member 210 and an inner surface 227 of the wall member 220. In an alternative embodiment, the seal groove 218 may be formed in the wall member 220 to receive the seal 290 which provides a fluid-tight connection between the first end member 210 and the wall member 220. In additional or alternative embodiments, the fluid-tight seal between the first end member 210 and the wall member 220 may be accomplished via a threaded connection (e.g., threads on end 224 of the wall member 220 which match threads on end 215 of the first end member 210), a metal-to-metal seal, etc.

The groove 217 may be formed on end 215 of the first end member 210 and open to an interior volume of the pressure cell 208. The groove 217 may be sized to receive the end 264 of the sample cell 260 therein. In an embodiment, the groove 217 may have a circular shape.

In embodiments, the second end member 230 may comprise a channel 231 formed therein, a shoulder 236 to receive the end 225 of the wall member 220, and a cylindrical space 237 to at least partially receive the piston 250. The second end member 230 may further comprise the apertures 209 of the apparatus 200.

The channel 231 may fluidly connect to the cylindrical space 237. In additional embodiments, the channel 231 may fluidly connect to a side 232 of the second end member 230. In such embodiments, at least a portion of the channel 231 may extend horizontally through the second end member 230. In additional alternative embodiments, the channel 231 may fluidly connect to the end 235 of the second end member 230. In such embodiments, the channel 231 may extend vertically through the second end member 230. In an embodiment, the channel 231 may be used to provide a pressurized fluid (e.g., hydraulic fluid) to the cylindrical space 237. Pressurized fluid may flow through channel 231 from a point (e.g., point 205 of FIGS. 2A and 2B) external of second end member 230 to the cylindrical space 237 and vice versa.

The cylindrical space 237 of the second end member 230 may be formed to receive the end 255 of the piston 250. In an embodiment, the cylindrical space 237 may be formed in a center of the second end member 230. A seal groove 238 may be formed in the second end member 230 which opens to the cylindrical space 237. In an alternative embodiment, the seal groove 238 may be formed in the piston 250 between the end 255 of the piston 250 and the channel 251 of the piston 250 (the end 255 and channel 251 of the piston 250 ARE described in more detail below). The seal groove 238 may be configured to receive a seal 291 (e.g., an O-ring) which provides a fluid-tight seal between the second end member 230 and the piston 250, even as the piston 250 moves in the cylindrical space 237.

In embodiments, the apertures 209 of the apparatus 200 may extend through the end 234 of the second end member 230. Lines 271 and 272 which fluidly connect the channel 251 of the piston 250 to points external of the pressure cell 208 extend through the apertures 209 in the second end member 230. In an embodiment such as in FIG. 3, the apertures 209 and the cylindrical space 237 form a continuous space within the second end member 230. The continuous space may receive the piston 250, and lines 271 and 272.

In an embodiment, the channel 231 of the second end member 230 may fluidly connect to a port formed in the side 232 of the second end member 230. The port of the second end member 230 can be configured to receive a fitting for a tubing line (e.g., line 275 of FIGS. 2A and 2B) which conveys a hydraulic fluid to and/or from a point (e.g., point 205 of FIGS. 2A and 2B) external of the pressure vessel 208.

The wall member 220 may comprise a first channel 221, a second channel 222, and a shoulder 223. The wall member 220 may further comprise the apertures 209 of the apparatus 200. The wall member 220 may comprise a hollow cylindrical shape.

The first channel 221 of the wall member 220 may fluidly connect to the interior volume of the pressure cell 208 and to a side 229 of the wall member 220. In an embodiment, the first channel 221 may extend horizontally through the wall member 220. The second channel 222 of the wall member 220 may fluidly connect to the interior volume of the pressure cell 208 and to the side 229 of the wall member 220. In an embodiment, the second channel 222 may extend horizontally through the wall member 220. In an embodiment, the first channel 221 of the wall member 220 may fluidly connect to a port formed in the side 229 of the wall member 220. In an embodiment, the first channel 221 may comprise a port formed in the side 229. In an embodiment, the second channel 222 of the wall member 220 may fluidly connect to a port formed in the side 229 of the wall member 220. In an embodiment, the second channel 222 may comprise a port formed in the side 229. The port(s) of the wall member 220 can be configured to receive a fitting for tubing lines (e.g., lines 276 and 277 of FIGS. 2A and 2B) which convey a fluid to and/or from a point (e.g., points 206 and 207 of FIGS. 2A and 2B) external of the pressure vessel 208.

In embodiments, the first channel 221 may be used to provide a confining fluid (e.g., air, water) to the interior volume of the pressure cell 208, to provide a pressure (e.g., 0 psi, a pressure of a subterranean formation, etc.) to the interior volume of the pressure cell 208, to bleed a fluid (e.g., air, confining fluid) from the interior volume of the pressure cell 208, to reduce a pressure of the of the pressure cell 208, or combinations thereof. In embodiments, the second channel 222 may be used to provide a confining fluid (e.g., air, water) to the interior volume of the pressure cell 208, to provide a pressure (e.g., 0 psi, a pressure of a subterranean formation, etc.) to the interior volume of the pressure cell 208, to bleed a fluid (e.g., air, confining fluid) from the interior volume of the pressure cell 208, to reduce a pressure of the of the pressure cell 208, or combinations thereof. For example, the first channel 221 may be used to provide a confining fluid (e.g., air, water) to the interior volume of the pressure cell 208 and to provide a pressure (e.g., 0 psi, a pressure of a subterranean formation, etc.) to the interior volume of the pressure cell 208, and the second channel 222 may be used to bleed a fluid (e.g., air, confining fluid) from the interior volume of the pressure cell 208 and to reduce a pressure of the of the pressure cell 208. In another example, the second channel 222 may be used to provide a confining fluid (e.g., air, water) to the interior volume of the pressure cell 208 and to provide a pressure (e.g., 0 psi, a pressure of a subterranean formation, etc.) to the interior volume of the pressure cell 208, and the first channel 221 may be used to bleed a fluid (e.g., air, confining fluid) from the interior volume of the pressure cell 208 and to reduce a pressure of the of the pressure cell 208.

The shoulder 223 of the wall member 220 may be configured to receive the ring member 240. As seen in FIG. 3, the shoulder 223 may comprise an L-shape contour. In an embodiment, the contour of the shoulder 223 is such that end 225 of the wall member 220 has a larger inner diameter than end 224 of the wall member 220 (e.g., the ring member 240 is inserted and placed into the wall member 220 via end 225). In an alternative embodiment, the shoulder 223 is located at the opposite end (i.e., end 224) such that end 224 of the wall member 220 has a larger inner diameter than end 225 of the wall member 220 (e.g., the ring member 240 is inserted and placed into the wall member 220 via end 224).

In embodiments, the apertures 209 of the apparatus 200 may extend through the end 225 of the wall member 220. Lines 271 and 272 which fluidly connect the channel 251 of the piston 250 to points external of the pressure cell 208 extend through the apertures 209 in the wall member 220. In an embodiment such as in FIG. 3, the apertures 209 are formed in the wall member 220 above the shoulder 223 of the wall member 220. For example, the ring member 240 is placed on the shoulder 223 of the wall member 220 such that lines 271 and 272 which fluidly connect the channel 251 of the piston 250 to points external of the pressure cell 208 extend through the apertures 209 in the wall member 220 and move within the apertures 209 above the area where the ring member 240 is placed.

The ring member 240 may comprise a hole 247 formed therein such that the piston 250 may slide through the ring member 240. An inner seal groove 241 and an outer seal groove 246 may be formed in the inner portion 242 and the outer portion 243 of the ring member 240, respectively. A seal 292 (e.g., an O-ring) may be placed in groove 241 to provide a fluid-tight seal between the piston 250 and the ring member 240. A seal 293 (e.g., an O-ring) may be placed in groove 246 to provide a fluid-tight seal between the wall member 220 and the ring member 240. In alternative embodiments, groove 241 may be formed in the inner surface 228 of the wall member 220, and seal 293 may be placed therein to provide a fluid-tight seal between the ring member 240 and the wall member 220. In alternative embodiments, groove 241 may be formed in the shoulder 223 of the wall member, and seal 293 may be placed therein to provide a fluid-tight seal between the ring member 240 and the shoulder 223 of the wall member 220. In alternative embodiments, groove 241 may be formed in the end 244 of the ring member 240, and seal 293 may be placed therein to provide a fluid-tight seal between the ring member 240 and the shoulder 223 of the wall member 220. In alternative embodiments, groove 246 may be formed in the piston 250, and seal 292 may be placed therein to provide a fluid-tight seal between the piston 250 and the ring member 240. In alternative embodiments, the fluid-tight seal between the ring member 240 and the wall member 220 may be accomplished via a threaded connection (e.g., threads on outer portion 243 of the ring member 240 which match threads on inner surface 228 of the wall member 220), a metal-to-metal seal, etc.

When the ring member 240 is placed into the wall member 220, the outer portion 243 may have metal-to-metal contact with the shoulder 223 of the wall member 220, the inner portion 242 may form a seal with the sample cell 260, or both. In embodiments, the ring member 240 may be formed as part (e.g., integrally) of the wall member 220 or the second end member 230.

Testing temperatures of the pressure cell 208 can range from room temperature to the high temperatures associated with downhole conditions and/or subterranean formation conditions (e.g., up to 1,000° F.). Testing pressures of the pressure cell 208 can range from ambient pressure to the high pressures associated with downhole conditions and/or subterranean conditions (e.g., up to 50,000 psi). The components (e.g., first end member 210, second end member 230, wall member 220, ring member 240) of the pressure cell 208 can be made from materials which are strong (e.g., able to maintain structural stability when subjected to high pressures), durable (e.g., resistant to corrosion by the anticipated pressurizing fluids in the anticipated temperature and pressure ranges), and can be formed with the precision necessary to maintain substantially pressure-tight engagement between the components under testing conditions. For example, the first end member 210, second end member 230, wall member 220, ring member 240, or combinations thereof can be machined from stainless steel. Alternatively, the first end member 210, second end member 230, wall member 220, ring member 240, or combinations thereof can be formed using casting, laminating, or molding techniques from materials including, for example, steel, alloys, composite fibers with a resin structure, or combinations thereof.

In embodiments, the sample cell 260 may comprise a tubular sleeve 261, a screen 262 adjacent end 264 of the tubular sleeve 261, and a screen 263 adjacent end 265 of the tubular sleeve 261. End 265 may receive the end 254 of the piston 250, and end 264 may insert into the groove 217 formed in end 215 of the first end member 210. The sample cell 260 may be disposed within the pressure cell 208.

The tubular sleeve 261 may define the sample volume wherein a sample of a subterranean formation (e.g., subterranean formation 102 of FIG. 1) is placed for testing in the apparatus 200. The sample volume may comprise a cylindrical shape. The tubular sleeve 261 may seal against the ring member 240 and the first end member 210 such that a fluid-tight seal fluidly isolates the sample volume on the interior of the tubular sleeve 261 from the annular space 226 formed between the sample cell 260 and the inner surface 227 of the wall member 220. The sample volume formed by the tubular sleeve 261 of the sample cell 260 may fluidly connect to the channel 211 of the first end member 210 and to the channel 251 of the piston 250.

The tubular sleeve 261 may comprise a polymeric and/or elastomeric material, e.g., rubber. In embodiments, the tubular sleeve 261 serves to provide a structural support for placement of a sample of a subterranean formation in the apparatus 200. In alternative embodiments, the tubular sleeve 261 serves to provide a structural support for placement of a sample of a subterranean formation as well as to seal against the ring member 240 and the first end member 210 to isolate the sample volume from the annular space 226. In such embodiments, the tubular sleeve 261 may provide a dual-functionality of containing a sample as well as sealing a sample from the annular space 226.

The screens 262 and 263 may comprise a mesh such as a wire mesh, fiber mesh, or both. The material of the screens 262 and 263 may comprise, for example, a polymer or a metal such as a stainless steel. The screens 262 and 263 may provide support above and below the sample in the sample cell 260 while providing fluid communication from the sample volume to the channel 251 of the piston 250 and from the sample volume to the channel 211 of the first end member 210. In embodiments, the screens 262 and 263 may comprise a fine mesh, a course mesh, or combinations thereof.

The piston 250 of the apparatus 200 generally comprises a cylindrical body. In embodiments, the piston 250 may comprise a channel 251 formed therein. The piston 250 may further comprise a cylindrical body which can move within the cylindrical space 237 of the second end member 230, within the hole 247 of the ring member 240, within the tubular sleeve 261 of the sample cell 260, or combinations thereof. As discussed above, the piston 250 may be partially received within the cylindrical space 237 of the second end member 230.

The channel 251 of the piston 250 may comprise a first portion 251*a*, a second portion 251*b*, and a third portion 251*c*. In the embodiment shown in FIG. 3, the first portion 251*a* of the channel 251 may fluidly connect to location on side 256 of the piston 250, the second portion 251*b* of the channel 251 may fluidly connect to another location on side 257 of the piston 250, and the third portion 251*c* of the channel 251 may fluidly connect to the end 254 of the piston 250. In an alternative embodiment, the first portion 251*a* of the channel 251, the second portion 251*b* of the channel 251, or both, may fluidly connect to end 255 of the piston 250. In such an embodiment, the piston 250 may be configured to extend entirely through the second end member 230, via end 235 of second end member 230.

In an embodiment, side 257 of the piston 250 may be located opposite of side 256 of the piston 250; alternatively, side 257 of the piston 250 may be located other than opposite of side 256 of the piston 250 (e.g., sides 256 and 257 are next to one another, sides 256 and 237 are spaced at an interval (e.g., 45°, 90°)). The port(s) of the piston 250 can be configured to receive a fitting for tubing lines (e.g., lines 271 and 272) which convey a fluid to and/or from a point (e.g., points 201 and 201 of FIGS. 2A and 2B) external of the pressure vessel 208.

The piston 250 may generally float in the cylindrical space 237 of the second end member 230, in the hole 247 of the ring member 240, in the tubular sleeve 261 of the sample cell 260, or combinations thereof. The piston 250 may comprise a machined stainless steel; alternatively, the piston 250 may comprise materials including steel, alloys, composite fibers with a resin structure, or combinations thereof, which are formed using casting, laminating, or molding techniques.

Lines 271 and 272 fluidly connect to the channel 251 of the piston 250 so as to fluidly connect the channel 251 to points (e.g., points 201 and 202 of FIGS. 2A and 2B) external of the pressure cell 208. Lines 271 and 272 may comprise tubing, such as stainless steel tubing.

FIG. 4 shows an embodiment of the disclosed system, with the apparatus 200 shown in cross-section. The system may comprise the apparatus 200 and a sample 280 (e.g., comprising a stabilizing product) of subterranean formation 102 placed within the sample cell 260 of the apparatus 200. When referring to the sample 280 herein, it is to be understood the sample 280 may comprise one of various embodiments, including a raw sample (e.g., a sample which has not been cleaned, treated, or tested), a cleaned sample (e.g., a sample which has been cleaned as described herein and not treated or tested), a treated sample (e.g., a sample which has been treated, and in some embodiments, cleaned and/or tested), and a tested sample (e.g., a sample which has been tested as described herein, and in some embodiments, cleaned and/or treated).

As shown in FIG. 4, the interior volume of the pressure cell 208 may be defined by the wall member 220, the ring member 240, the piston 250, and the first end member 210. The sample cell 260 may occupy the interior volume of the pressure cell 208 such that annular space 226 is defined by the space between the wall member 220 and the sample cell 260 and between the ring member 240 and the first end member 210. As can be seen, the end 265 of the sample cell 260 may receive the piston 250 and the end 264 of the sample cell 260 may receive the first end member 210 via groove 217.

As can be seen in FIG. 4, the end 264 of the sample cell 260 is placed within groove 217 formed in the first end member 210. The end 265 of the sample cell 260 may form a seal with the ring member 240 such that the sample volume of the sample cell 260 is fluidly isolated from the annular space 226 between the sample cell 260 and the wall member 220. The tubular sleeve 261 of the sample cell 260 may provide support around the sides of the sample 280. The screens 262 and 263 may provide support above and below the sample 280.

In an embodiment, the first channel 221 of the wall member 220 may fluidly connect to the interior volume of the pressure cell 208 and to a point 206 external of the pressure cell 208. In an embodiment, the second channel 222 of the wall member 220 may fluidly connect to the interior volume of the pressure cell 208 and to a point 207 external of the pressure cell 208.

The interior volume of the pressure cell 208, the sample volume of the sample cell 260, the annular space 226 (e.g., confining space), or combinations thereof, which may experience pressures different than ambient pressure during preparation and testing, are fluidly isolated from the ambient pressure of the apertures 209 by the fluid-tight seal between the piston 250 and the ring member 240 (e.g., formed by seal 292), between the ring member 240 and the wall member 220 (e.g., formed by seal 293), between the wall member 220 and the first end member 210 (e.g., formed by seal 290), or combinations thereof.

The piston 250 can be seen as extending within the cylindrical space 237 of the second end member 230 and the hole 247 of the ring member 240. The piston 250 may be actuated in an axial direction (indicated by the double-ended arrow x in FIG. 4) upon the sample 280 (e.g., via screen 263) in the sample cell 260.

A hydraulic volume 239 may be created between the top of the cylindrical space 237 of the second end member 230 and the top of the piston 250 as the piston 250 moves (e.g., is actuated) downwardly through the cylindrical space 237 and the ring member 240 toward the sample cell 260. To move the piston 250 downwardly against the sample, hydraulic fluid may be supplied (e.g., via a pump and/or pressurized vessel) from the point 205 external of the pressure cell 208, through line 275 comprising valve 285 (e.g., in an open position), through channel 231, and into the hydraulic volume 239. In embodiments, a controller may be used to control the pressure of the hydraulic fluid in the hydraulic volume 239 (and thus the axial load applied to the sample and stabilizing product).

As can be seen, a portion of the piston 250 may be exposed to the atmosphere via the apertures 209 of the apparatus 200 so that the channel 251 formed in the piston 250 may fluidly connect to points 201 and 202 external of the pressure cell 208 (e.g., via lines 271 and 272). The hydraulic volume 239, which may experience pressures different than ambient pressure during preparation and testing, is fluidly isolated from the ambient pressure of the apertures 209 by the fluid-tight seal between the second end member 230 and the piston 250 (e.g., formed by seal 291).

In embodiments, the apparatus 200 of the system may include sensors to measure parameters used to calculate properties of samples being tested. For example, the apparatus 200 may include linear variable displacement transducers (LVDTs) positioned at 120° intervals in a circle around the sample cell 260 or in other suitable positions. The average reading of the LVDTs can be used to characterize any length change of a sample tested in the sample cell 260. Additionally, LVDTs can be used to measure tangential changes in deformation of the sample. Other sensors, such as extensometers, electrical strain gauges or fiber optic strain gauges, can be used in addition to or in place of the LVDTs to measure relevant parameters. For example, four strain gauges (two vertical and two tangential) could be attached to the inner surface of the tubular sleeve 261 (e.g., adjacent and/or proximate sample 280) to provide material data that would be difficult to obtain otherwise. Alternatively, strain gauges could be attached to the exterior surface of the tubular sleeve 261. Similarly, the amount of fluid (e.g., water) pumped into the pressure cell 208 (e.g., in annular space 228) can provide a measure of change in sample size or length. Pressure and temperature sensors can be included to measure pressures and temperatures present during testing. Pressure, temperature, and strain sensors can be used as feedback to control a testing process. For example, pressure sensors can be used to control a confining pressure source (e.g., via a pump) to add or relieve confining pressure (e.g., a pressure in the lateral direction indicated by double-ended arrow y in FIG. 4) depending upon a controlled setpoint. Additionally, the load exerted upon the sample by the piston 250 can be controlled depending on the strain measurements.

In embodiments, sensors comprising pressure transducers may be associated with one or more lines 271, 272, 273, 274, 275, 276, 277, or combinations thereof. The pressure transducers may measure a pressure in the apparatus 200 in an area fluidly connected to the respective line, as described herein.

In embodiments, the apparatus 200 of the system may include a controller to control components associated with the operation of the apparatus 200, for example, valves 281, 282, 283, 284, 285, 286, 287 (e.g., control of degree of rotation or movement from an open position to a closed position), any pumps (e.g., control a pressure, flow rate, or both) associated with the points 201,202, 203, 204, 205, 206, 207 external of the pressure cell 208, any of the above-discussed sensors (e.g., control the valves or pumps based on sensor measurements), or combinations thereof.

Assembly and operation of the embodiments of the disclosed apparatus 200 and system may comprise various steps which may be performed as disclosed herein; alternatively, in different sequences.

The tubular sleeve 261 of the sample cell 260 may be placed into the groove 217 of the first end member 210. The end 264 of the sample cell 260 may form a seal with the first end member 210 such that the sample volume of the sample cell 260 is fluidly isolated from the annular space 226 between the sample cell 260 and the wall member 220.

The end 224 of the wall member 220 may be placed on the shoulder 216 of the first end member 210. The seal 290 may form a fluid-tight seal between the wall member 220 and the first end member 210. In embodiments, the first end member 210 and the wall member 220 may connect via a threaded connection (e.g., threads on end 224 of the wall member 220 which match threads on end 215 of the first end member 210) and/or the wall member 220 may have metal-to-metal contact (e.g., a loose-fit configuration) with the shoulder 216 of the first end member 210.

The screen 262 may be placed in the sample cell 260 such that the screen 262 abuts the end 215 of the first end member 210 and extends over the channel 211.

The sample 280 may be placed into the sample volume of the sample cell 260 (e.g., in the tubular sleeve 261). In embodiments, the sample 280 may comprise a length of about 2 inches or greater and a width (e.g., diameter) of about 1 inch or greater. In embodiments having screen 262, the sample 280 may be placed on the screen 262 after placement of the screen 262 as specified above. The sample 280 of the subterranean formation 102 may comprise a generally cylindrical shape, although unstable samples may be comprise a granular, powder, particulate, and/or fluid portion which can assume a cylindrical shape when placed in the sample cell 260 of the apparatus 200. In embodiments, the sample 280 may not be perfectly cylindrical in shape due to pores, holes, cracks, etc. After the sample 280 is placed in the sample cell 260, screen 263 may be placed on top of the sample 280.

After placement of the wall member 220 on the first end member 210 and after placement of the tubular sleeve 261 on the first end member 210, the ring member 240 may be placed on the shoulder 223 of the wall member 220. A fluid-tight seal is created by seal 293 between the wall member 220 and the ring member 240. In embodiments, the ring member 240 and the wall member 220 may connect via a threaded connection (e.g., threads on outer portion 243 of the ring member 240 which match threads on the inner surface 228 of the wall member 220) and/or the ring member 240 may have metal-to-metal contact (e.g., a loose-fit configuration) with the shoulder 223 of the wall member 220.

After placement of the sample 280 in the sample cell 260, the piston 250 may be placed in the ring member 240 such that a fluid-tight seal is created by seal 292 between the piston 250 and the ring member 240. The piston 250 is slidable up and down (e.g., in an axial direction indicated by double-ended arrow x in FIG. 4) relative to the seal 292.

After placement of the piston 250, the second end member 230 may then be placed over the piston 250 such that the end 234 of the second end member 230 abuts the ring member 240, the shoulder 236 of the second end member 230 receives the end 225 of the wall member 220, and the cylindrical space 237 receives the piston 250. In embodiments, the second end member 230 and the wall member 220 may connect via a threaded connection (e.g., threads on end 234 of the second end member 230 which match threads on the inner surface 228 of the wall member 220) and/or the second end member 230 may have metal-to-metal contact (e.g., a loose-fit configuration) with the shoulder 223 of the wall member 220.

Lines 271 and 272 may be connected (e.g., via a port as discussed above) to the channel 251 of the piston 250 before the piston is placed in the ring member 240, after the piston is placed in the ring member 240, before the second end member 230 is placed on the wall member 220, or after the second end member 230 is placed on the wall member 220.

Lines 273, 274, 275, 276, 277 may be connected (e.g., via a port as discussed above) to the apparatus 200 at any point in the assembly of the system.

After all components of apparatus 200 are assembled and the sample 280 is placed in the sample cell 260, the stabilizing product may be introduced to the sample cell 260. In embodiments, a stabilizing product may be introduced to the sample cell 260 by flowing stabilizing product from point 203, through line 273 comprising valve 283, through at least a portion of the channel 211 (e.g., first portion 211*a* and third portion 211*c* of FIG. 3) and into the sample cell 260. In additional or alternative embodiments, a stabilizing product may be introduced to the sample cell 260 by flowing stabilizing product from point 204, through line 274 comprising valve 284, through at least a portion of the channel 211 (e.g., third portion 211*c* and second portion 211*b* of FIG. 3) and into the sample cell 260. In additional or alternative embodiments, a stabilizing product may be introduced to the sample cell 260 by flowing stabilizing product from point 201, through line 271 comprising valve 281, through at least a portion of the channel 251 (e.g., first portion 251*a* and third portions 251*c* of FIG. 3) and into the sample cell 260. In additional or alternative embodiments, a stabilizing product may be introduced to the sample cell 260 by flowing stabilizing product from point 202, through line 272 comprising valve 282, through at least a portion of the channel 211 (e.g., third portion 251*c* and second portion 251*b* of FIG. 3) and into the sample cell 260.

In embodiments where a portion of a channel is not utilized to introduce stabilizing product into the sample cell 260, the valve of the line associated with the respective portion of the channel may be in the open position or in the closed position. For example, in an embodiment where the first portion 211*a* is not utilized to introduce stabilizing product, the valve 283 may be set to a closed position so that stabilizing product is not lost to a point 203 external of the pressure cell 208. In an alternative embodiment, the valve 283 may be set to an open position so that stabilizing product flows through valve 283 and to a point 203 external of the pressure cell 208.

In embodiments, after stabilizing product is added to the sample 280 in the sample cell 260, one or both channels 211, 251 and one or more of lines 271, 272, 274, 275 may be flushed (e.g., with a flushing fluid) to remove residual (e.g., excess) stabilizing product in the lines and/or any debris from the sample 280. For example, to flush lines 271 and 272 and channel 251, valves 284 and 283 of lines 274 and 273 can be set to a closed position, and valves 281 and 282 of lines 271 and 272 can be set to the open position. A flushing fluid (e.g., water) can then be flowed (e.g., pumped) from point 201 through line 271, through channel 251, and through line 272 to point 202; alternatively, a flushing fluid (e.g., water) can then be flowed (e.g., pumped) from point 202 through line 272, through channel 251, and through line 271 to point 201. To flush lines 274 and 273 and channel 211, valves 281 and 282 of lines 271 and 272 can be set to a closed position, and valves 284 and 283 of lines 274 and 273 can be set to an open position. A flushing fluid (e.g., water) can then be flowed (e.g., pumped) from point 204 external of pressure cell 208 through line 274, through channel 211, and through line 273 to point 203 external of pressure cell 208; alternatively, a flushing fluid (e.g., water) can then be flowed (e.g., pumped) from point 203 external of pressure cell 208 through line 273, through channel 211, and through line 274 to point 204 external of pressure cell 208.

The annular space 226 may be filled with a confining fluid which may provide a confining pressure (e.g., a pressure in a lateral direction) to the sample 280 (in the form of a raw sample, a cleaned sample, a treated sample, or combinations thereof) in the sample cell 260. The confining fluid may be introduced from point 206 external of the pressure cell 208, through line 276 comprising a valve 286 (e.g., in an open position), through channel 221 formed in the wall member 220, and into the annular space 226. In an embodiment, the confining fluid may comprise water, and water is introduced to the annular space 226 from point 206 comprising a pump. As confining fluid is introduced into the annular space 226, any air displaced by confining fluid introduced to the annular space 226 may flow through channel 222 formed in the wall member 220, through line 277 comprising valve 287 (e.g., in an open position), to a point 207 external of the pressure cell 208 (e.g., into the atmosphere). Once the annular space 226 is charged with confining fluid, the valve 286 and valve 287 may be closed to contain the confining fluid within the annular space 226.

In embodiments, the sample 280 (e.g., the treated sample comprising the stabilizing product) may require curing (e.g., in an embodiment where the stabilizing product comprises a resin). Curing may be performed under desired temperatures and pressures. The temperature and pressure of the system (or a series of temperatures and pressures) may be set and/or controlled as described herein below. Curing time may be determined by the stabilizing product used.

After all components of the apparatus 200 are assembled and the sample 280 is placed in the sample cell 260, the sample 280 (e.g., in the form of a raw sample, a cleaned sample, a treated sample, or combinations thereof) may be tested for properties with or without the addition of the stabilizing product. Testing properties before addition of the stabilizing product may provide baseline properties of the sample 280 of subterranean formation 102 before addition of the stabilizing product. Testing properties after addition of the stabilizing product may provide properties of the sample 280 (e.g., a treated sample) which may be compared to desired property values and/or to the baseline properties obtained.

To test the sample 280 (e.g., for permeability), a fluid (e.g., a permeating fluid such as air, water, nitrogen, a salt solution, or combinations thereof) may be supplied at point 203 and/or 204 external of the pressure cell 208 (e.g., comprising a pressurized vessel, a pump, or both). Point 203 and/or 204 may further comprise a flow measurement instrument which measures the amount or flow of fluid flowing to the sample 280. In embodiments, the fluid may flow through line 273 comprising valve 283 (e.g., in the open position) into channel 211 (e.g., first portion 211*a* and third portion 211*c* shown in FIG. 3), the fluid may flow through line 274 comprising valve 284 (e.g., in the open position) into channel 211 (e.g., second portion 211*b* and third portion 211*c* shown in FIG. 3), or both. The fluid may then flow from the channel 211 upward through the sample 280. The fluid may then flow from the sample 280 outward through line 271 (e.g., via third portion 251*c* and first portion 251*a* of channel 251 of the piston 250 shown in FIG. 3) comprising valve 281 (e.g., in the open position) to point 201 external of the pressure vessel 208, the fluid may then flow from the sample 280 outward through line 272 (e.g., via third portion 251*c* and second portion 251*b* of channel 251 of the piston 250 shown in FIG. 3) comprising valve 282 (e.g., in the open position) to point 202 external of the pressure vessel 208, or both. In an embodiment, the point 201 and/or 202 may comprise a measurement instrument which measures the amount of fluid flowing from the sample 280. In embodiments where fluid does not flow through line 271, 272, 273, 274, or combinations thereof, the respective valves 281, 282, 283, 284, or combinations thereof, may be set in a closed position.

Alternatively, to test the sample 280 (e.g., for baseline permeability), a fluid (e.g., a permeating fluid such as air, water, nitrogen, a salt solution, or combinations thereof) may be supplied at point 201 and/or 202 external of the pressure cell 208 (e.g., comprising a pressurized vessel, a pump, or both). Point 201 and/or 202 may further comprise a flow measurement instrument which measures the amount or flow of fluid flowing to the sample 280. In embodiments, the fluid may flow through line 271 comprising valve 281 (e.g., in the open position) into channel 251 (e.g., first portion 251*a* and third portion 251*c* shown in FIG. 3), the fluid may flow through line 272 comprising valve 282 (e.g., in the open position) into channel 251 (e.g., second portion 251*b* and third portion 251*c* shown in FIG. 3), or both. The fluid may then flow downward from the channel 251 through the sample 280. The fluid may then flow from the sample 280 outward through line 273 (e.g., via third portion 211*c* and first portion 211*a* of channel 211 of the first end member 210 shown in FIG. 3) comprising valve 283 (e.g., in the open position) to point 203 external of the pressure vessel 208, the fluid may then flow from the sample 280 outward through line 274 (e.g., via third portion 211*c* and second portion 211*b* of channel 211 of the first end member 210 shown in FIG. 3) comprising valve 284 (e.g., in the open position) to point 204 external of the pressure vessel 208, or both. In an embodiment, the point 203 and/or 204 may comprise a measurement instrument which measures the amount of fluid flowing from the sample 280. In embodiments where fluid does not flow through line 271, 272, 273, 274, or combinations thereof, the respective valves 281, 282, 283, 284, or combinations thereof, may be set in a closed position.

In embodiments, valves 286 and 287 may be in the closed position during testing.

The sample 280 may be tested for compressive properties. Generally, if the sample 280 is tested for compressive properties, upon failure of the sample 280, the sample 280 is removed after disassembly of the apparatus 200 and another sample is placed in the system and the apparatus 200 is reassembled.

To test the sample 280 for compressive properties, a hydraulic fluid is supplied from point 205 external of the pressure cell 208 (e.g., via a pressurized vessel or pump), through line 275 comprising valve 285, through channel 231 of the second end member 230, into the hydraulic volume 239 of the cylindrical space 237. The pressure provided in the hydraulic volume 237 actuates the piston 250, and the piston 250 applies an axial pressure or force (e.g., a pressure or force in the axial direction indicated by double-ended arrow x in FIG. 4) onto the sample 280 in the sample cell 260. The axial pressure on the sample 280 may be incrementally increased (e.g., manually or via a controller) until failure of the sample 280. Failure of the sample 280 can be indicated, for example, by a rapid change in sample dimensions. This causes a rapid change in the pressure in line 275 which pushes piston 250 down to break the sample 280. The rapid change in pressure may be sensed by sensors (e.g., pressure transducers).

In embodiments, valves 281, 282, 283, 284, 286, 287, or combinations thereof may be in the closed position during compression testing. In additional or alternative embodiments, valves 281, 282, 283, 284, 285, 286, 287, or combinations thereof, may be in the open position during compression testing.

The temperature and pressure used during treating and testing can be chosen and controlled.

For example, temperature can be controlled to simulate downhole conditions or subterranean formation conditions. To achieve a particular temperature, the apparatus 200 and/or the system comprising the sample 280 can be heated. Additionally or alternatively, temperatures of the system can be controlled using external heating elements (e.g., heater coils or stainless steel heater bands) or by placing the system in an oven.

The pressures can also be controlled. The pressure on the sample 280 may comprise a confining pressure (e.g., a pressure in the lateral direction indicated by double-ended arrow y in FIG. 4) and an axial pressure (e.g., a pressure in the axial direction indicated by double-ended arrow x in FIG. 4). In the disclosed embodiments, the confining pressure, or lateral pressure, on the sample 280 may be controlled independently of the axial pressure on the sample 280. For example, the confining pressure may be controlled by charging the system with a confining fluid (described above), and maintain a confining pressure at about 0 psi or greater than 0 psi (e.g., about 100 psi to about 300 psi, or greater). The axial pressure may be controlled by applying a pressure on the piston 250 with a hydraulic fluid as described herein.

In embodiments, the confining pressure supplied by the confining fluid and the axial pressure supplied by the piston 250 upon the sample 280 in the sample cell 260 may be about equal. For example, the confining pressure and the axial pressure may each comprise about 0 psi; alternatively, about 100 psi; alternatively, about 300 psi. Providing a confining pressure about equal to the axial pressure (e.g., during curing) provides for uniform load on the sample 280. In an embodiment, the axial pressure and the confining pressure are each about 0 psi during treating of the sample 280. In an alternative embodiment, the axial pressure and the confining pressure are each greater than 0 psi (e.g., about 300 psi or greater) during treating of the sample 280.

In embodiments, the confining pressure supplied by the confining fluid may be less than the axial pressure supplied by the piston 250 upon the sample 280 in the sample cell 260. For example, during compression testing of the sample 280, the confining pressure may comprise a pressure less than the axial pressure, including about 0 psi.

In embodiments, the confining pressure supplied by the confining fluid may be greater than the axial pressure supplied by the piston 250 upon the sample 280 in the sample cell 260. For example, during compression testing of the sample 208, the confining pressure may comprise a pressure greater than the axial pressure.

In embodiments, the confining pressure and axial pressure used during preparation (e.g., cleaning, treating, or combinations thereof) of the sample 280 may be set at, for example, between about 100 to about 300 psi. After curing, the confining pressure may be reduced, for example, to a pressure below 100 to about 300 psi (e.g., 0 psi or ambient pressure) by opening valve 286 and/or valve 287 to release confining fluid and/or confining pressure from the pressure cell 208. The axial pressure may then be incrementally increased as described herein until failure of the sample 280.

In alternative embodiments, the confining pressure and axial pressure used during preparation (e.g., cleaning, treating, or combinations thereof) of the sample 280 may be set at, for example, about 100 to about 300 psi. After treating, the confining pressure may be maintained at about 300 psi (or at a pressure higher than 0 psi) while the axial pressure is incrementally increased as described herein until failure of the sample 280 or until a maximum safe point pressure is reached.

In embodiments, a method for utilizing the disclosed apparatus 200 may comprise providing an apparatus 200 comprising a pressure cell 208 defining an interior volume, and a sample cell 260 positioned within the interior volume of the pressure cell 208, wherein the pressure cell 208 comprises a channel 211 formed therein, wherein the channel 211 of the pressure cell fluidly communicates with a first point 203 external of the pressure cell, with a second point 204 external of the pressure cell, and with the sample cell 260; loading a sample 280 of a subterranean formation 102 into the sample cell 260; preparing the sample 280; testing the prepared sample 280 in-situ of the sample cell 260; or combinations thereof.

In embodiments, the step of providing an apparatus 200 may comprise providing any of the embodiments of the apparatus 200 disclosed herein. In additional or alternative embodiments, providing the apparatus 200 may comprise placing the apparatus 200 in a steel support frame which, for example, supports the apparatus 200 on a bottom of the first end member 210 and on a top of the second end member 230. In additional or alternative embodiments, the steel support frame may serve to clamp the apparatus 200 components together via contact with the bottom of the first end member 210 and the top of the second end member 230.

In embodiments, preparing the sample 280 may comprise weighing the sample 280 (e.g., in raw form, with an analytical balance), cleaning the sample 280, weighing the cleaned sample 280 (e.g., with an analytical balance), and determining any difference between weights of the sample 280 before and after cleaning (e.g., to evaluate an oil and/or water content of the raw form of the sample 280). In an embodiment, the sample 280 may be cleaned prior to loading into the apparatus 200. In an embodiment, cleaning the sample 280 may comprise performing the method of American Petroleum Institute Standard API RP40 on the sample 280. In embodiments, cleaning the sample 280 may further comprise drying the sample 280, for example in a convection oven, humidity oven, vacuum oven, or combinations thereof. In an embodiment, the drying oven may have a temperature control of ± about 2° C.

In additional or alternative embodiments, preparing the sample 280 may comprise providing a confining pressure to the sample 280 in the apparatus 200. For example, providing a confining pressure may comprise providing a pressure of about 100 psi and then incrementally increasing the confining pressure to about 300 psi.

In additional or alternative embodiments, preparing the sample 280 may comprise determining a permeability of the sample 280. In an embodiment, determining a permeability of the sample 280 may comprise flowing a permeating fluid through the sample 280 in the sample cell 260 at one or more flow rates (e.g., 5 ml/min, 10 ml/min, 15 ml/min, 20 ml/min, or combinations thereof), for example, before the sample 280 is treated. In an additional or alternative embodiment, determining a permeability may comprise measuring a pressure differential across the sample 280 in the sample cell 260. In an embodiment, the pressure differential may be in the range of from about 0.3 to about 1.5 psi.

In additional or alternative embodiments, preparing the sample 280 may comprise treating the sample 280 in-situ of the sample cell 260. In embodiments, treating the sample 280 may comprise providing a stabilizing product; flowing a sample of the stabilizing product into the sample cell 260 via the channel 211 formed in the pressure cell 208, via the channel 251 formed in the piston 250, or both; flushing one or more lines and/or one or more channels of the apparatus 200; increasing a temperature of the sample 280, the stabilizing product, or both; curing the stabilizing product in-situ of the sample cell 260; decreasing a temperature of the sample 280, stabilizing product, or both; or combinations thereof.

In embodiments, the stabilizing product may be provided by mixing one or more components to form a conformance sealant, an acid, a resin, or combinations thereof.

In embodiments, flowing a sample of the stabilizing product into the sample cell 260 via channels 211 and/or 251 may be accomplished via lines 271, 272, 273, 274, or combinations thereof from one or more points 201, 202, 203, 204, or combinations thereof external of the apparatus 200. In an embodiment, the sample of stabilizing product may flow at, or the sample 280 within the apparatus 200 may be heated to, a treating temperature (e.g., about 160° F. to about 200° F.).

In embodiments, flushing one or more line and/or one or more channels of the apparatus 200 may comprise flushing lines 271, 272, 273, 274, or combinations thereof and channels 211 and/or 251. In additional or alternative embodiments, the step of flushing may comprise flowing a flushing fluid from the first point 203 external of the pressure cell 208, through the channel 211 of the pressure cell 208, and to the second point 204 external of the pressure cell 208. In an embodiment, the step of flushing may comprise flowing a flushing fluid through lines 271, 272, 273, 274, or combinations thereof and channels 211 and/or 251 at a temperature of about 160° F., for a period of greater than about 24 hours, or both. Flowing a flushing fluid may remove residual stabilizing product in the channel 211 of the first end member 210 of the pressure cell 208. In an embodiment, the flushing fluid may comprise a 3% KCl solution.

In embodiments, increasing a temperature of the sample 280 may comprise heating to a first temperature (e.g., about 160° F.), heating to a second temperature (e.g., about 180° F.), heating to a third temperature (e.g., about 190° F.), heating to fourth temperature (e.g., about 200° F.), or combinations thereof. In an embodiment, increasing a temperature may comprise heating to a first temperature (e.g., about 160° F.), optionally holding the first temperature for a first period of time (e.g., minutes, hours, days, or combinations thereof), heating to a second temperature (e.g., about 180° F.), holding the second temperature for a second period of time (e.g., minutes, hours, days, or combinations thereof; greater that about 5, 6, 7, 8, 9, 10, 11, 12, 13, or more hours), heating to third temperature (e.g., about 190° F.), holding the third temperature for a third period of time (e.g., minutes, hours, days, or combinations thereof; greater than about 1, 2, 3, 4, 5 or more hours); heating to a fourth temperature (e.g., about 200° F.), holding the fourth temperature for a fourth period of time (e.g., minutes, hours, days, or combinations thereof, to cure the treated sample 280; for greater than about 1, 2, 3, 4, 5, 6, 7, 8, 9, 10, 11, 12, 13, 14, 15, 16, 17, 18, 19, 20, 21, 22, 23, 24 or more hours), or combinations thereof.

In embodiments, decreasing a temperature of the sample 280 may comprise cooling the apparatus 200 to about ambient temperature. In embodiments, decreasing a temperature may be performed before, during, or after a step of increasing a temperature.

In embodiments, the step of testing a sample 280 may comprise determining a regain permeability of the sample 280 (e.g., comprising the stabilizing product), determining a compressive strength of the sample 280, or both.

In embodiments, determining a regain permeability of the sample 280 may comprise flowing a regain permeating fluid (e.g., air, water, nitrogen, a salt solution, or combinations thereof) through the sample 280 (e.g., comprising the stabilizing product) within the sample cell 260 at one or more flow rates (e.g., 5 ml/min, 10 ml/min, 15 ml/min, 20 ml/min, or combinations thereof). In an embodiment, the regain permeating fluid may comprise a 3% KCl salt solution (e.g., a brine). In an additional or alternative embodiment, determining a regain permeability may comprise measuring a pressure differential across the sample 280 in the sample cell 260. In an embodiment, the pressure differential may be in the range of from about 0.2 to about 2.1 psi.

In embodiments, determining a compressive strength of the sample 280 may comprise adjusting a confining pressure of the sample 280, applying (e.g., incrementally increasing) an axial pressure upon the sample 280 until failure of the sample 280, or both. In an embodiment, adjusting a confining pressure of the sample 280 may comprise adjusting the confining pressure to about 300 psi. In embodiments, applying (e.g., incrementally increasing) an axial pressure upon the sample 280 until failure of the sample 280 may comprise flowing a pressurized fluid (e.g., in the hydraulic volume 237 of the apparatus 200) at a constant flow rate (e.g., about 0.5 ml/min) until failure of the sample 280. In additional or alternative embodiments, applying an axial pressure may comprise actuating a piston 250 upon the sample cell 260.

In alternative embodiments, determining a compressive strength of the sample 280 may comprise adjusting a confining pressure of the sample 280, applying (e.g., incrementally increasing) an axial pressure upon the sample 280 until a maximum safe point pressure is reached (e.g., in embodiments where the treated sample is stronger than required and does not fail), repeating application of the axial pressure until the maximum safe point pressure is reached, or combinations thereof. In embodiments, applying (e.g., incrementally increasing) an axial pressure upon the sample 280 until a maximum safe point pressure is reached (e.g., in embodiments where the treated sample is stronger than required and does not fail) may comprise flowing a pressurized fluid in the hydraulic volume 237 at a constant flow rate (e.g., about 0.5 ml/min) until the maximum safe point pressure is reached. In embodiments, the maximum safe point pressure is greater than about 800 psi. In embodiments, after the maximum safe point pressure is reached, the axial pressure may be reduced (e.g., to about 800 psi, then to about 600 psi, then to about 300 psi). In additional or alternative embodiments, applying an axial pressure may comprise actuating a piston 250 upon the sample cell 260.

In embodiments of methods having a step for providing a confining pressure and/or a step for adjusting a confining pressure, either or both of said steps may comprise flowing a fluid (e.g., a confining fluid as discussed hereinabove) into the annular space 226 of the pressure cell 208 surrounding the sample cell 260 via a channel 221 formed in the wall member 220 of the pressure cell 208. The confining pressure may be provided and/or adjusted during treating and/or testing, wherein the confining pressure in the step of treating is about equal to the confining pressure during the step of testing. In an alternative embodiment, a first confining pressure may be provided during the step of curing and the first confining pressure may be adjusted to a second confining pressure during the step of testing, wherein the first confining pressure is different than (e.g., greater than) the second confining pressure.

In embodiments, the method may further comprise placing the stabilizing product into a subterranean formation (e.g., subterranean formation 102 of FIG. 1). For example, a suitable stabilizing product may be found through use of the disclosed apparatus 200 and system for testing a sample of subterranean formation 102 from problem zone 150. The suitable stabilizing product may then be placed into the subterranean formation 102 at problem zone 150 to stabilize the subterranean formation 102. The suitable stabilizing product may be placed into subterranean formation 102 utilizing the work string 112 and other equipment associated with wellbore environment 100 of FIG. 1.

The disclosed embodiments provide for preparation (e.g., by curing) of a sample 280 of subterranean formation 102 (e.g., comprising a stabilizing product, and testing of the sample 280 in-situ the disclosed apparatus 200 and system, i.e., without removal of the sample 280 from the apparatus 200 and system. Moreover, embodiments are provided whereby the pressures exerted on the sample 280 are independently controllable in the axial and lateral directions. Further, the disclosed embodiments allow for preparation at one or more temperatures and pressures which can be the same as or different than one or more temperatures and pressures at which the sample 280 is tested. Additionally, the flow rate of stabilizing product or other fluid into the apparatus 200 may be controlled. Further still, the disclosed embodiments can prepare and test a sample 280 of subterranean formation 102 at conditions found in the wellbore 114 and/or subterranean formation 102.

The dual functionality of i) preparation (e.g., cleaning, treating, or combinations thereof) and ii) testing of the sample 280 in-situ of the apparatus 200 avoids removal of the sample 280 from the apparatus 200 in order to test the sample 280, which avoids imparting damage to the sample 280 or reducing the size of the sample 280 due to sample removal.

The following are nonlimiting, specific embodiments in accordance with the present disclosure:

A first embodiment, which is an apparatus for preparing and testing a sample of a subterranean formation, the apparatus comprising:

a pressure cell defining an interior volume, the pressure cell comprising:

a first end member comprising a channel formed therein;

a second end member;

a wall member positioned between the first end member and the second end member; and a sample cell positioned within the interior volume of the pressure cell;

wherein the channel of the first end member fluidly connects with a first point external of the pressure cell, with a second point external of the pressure cell, and with the sample cell.

A second embodiment, which is the apparatus of the first embodiment, further comprising a piston at least partially received in the second end member, wherein the piston comprises a channel formed therein, wherein the channel of the piston fluidly connects with a third point external of the pressure cell, with a fourth point external of the pressure cell, and with the sample cell.

A third embodiment, which is the apparatus of any of the first through second embodiments, wherein the second end member comprises a cylindrical space formed therein and a channel formed therein, wherein the channel of the second end member fluidly connects with a fifth point external of the pressure cell and with the cylindrical space.

A fourth embodiment, which is the apparatus of any of the first through third embodiments, wherein the wall member comprises a first channel formed therein and a second channel formed therein, wherein the first channel of the wall member fluidly connects with the interior volume and with a sixth point external of the pressure cell, wherein the second channel of the wall member fluidly communicates with the interior volume and a seventh point external of the pressure cell.

A fifth embodiment, which is the apparatus of any of the first through fourth embodiments, wherein the wall member and the sample cell define an annular space therebetween.

A sixth embodiment, which is the apparatus of any of the first through fifth embodiments, wherein the first end member further comprises a groove which receives an end of the sample cell.

A seventh embodiment, which is the apparatus of any of the first through sixth embodiments, further comprising a ring member positioned between the second end member and the sample cell.

An eighth embodiment, which is the apparatus of any of the first through seventh embodiments, wherein the sample cell comprises a tubular sleeve positioned between the first end member and the second end member of the pressure cell.

A ninth embodiment, which is the apparatus of any of the first through eighth embodiments, wherein the pressure cell further comprises an aperture formed in the second end member and in the wall member.

A tenth embodiment, which is a system for preparing and testing a subterranean sample, the system comprising:

an apparatus comprising:

a pressure cell defining an interior volume, wherein the pressure cell comprises a channel formed therein; and a sample cell positioned within the interior volume of the pressure cell, wherein the channel of the pressure cell fluidly communicates with a first point external of the pressure cell, with a second point external of the pressure cell, and with the sample cell;

a sample of a subterranean formation placed within the sample cell; and a resin placed within the sample cell.

An eleventh embodiment, which is the system of the tenth embodiment, wherein the apparatus further comprises a piston comprising a channel formed therein, wherein the channel of the piston fluidly communicates with a third point external of the pressure cell, with a fourth point external of the pressure cell, and with the sample cell.

A twelfth embodiment, which is the system of any of the tenth through eleventh embodiments, wherein the resin is placed within the sample cell via the channel of the pressure cell.

A thirteenth embodiment, which is the system of any of the tenth through twelfth embodiments, wherein the pressure cell and the sample cell define an annular space therebetween.

A fourteen embodiment, which is a method comprising:

providing an apparatus comprising a pressure cell defining an interior volume, and a sample cell positioned within the interior volume of the pressure cell, wherein the pressure cell comprises a channel formed therein, wherein the channel of the pressure cell fluidly communicates with a first point external of the pressure cell, with a second point external of the pressure cell, and with the sample cell;

loading a sample of a subterranean formation into the sample cell;

providing a stabilizing product;

flowing a sample of the stabilizing product into the sample cell via the channel formed in the pressure cell;

curing the stabilizing product in-situ of the sample cell; and testing the stabilized sample in-situ of the sample cell.

A fifteenth embodiment, which is the method of the fourteenth embodiment, further comprising:

placing the stabilizing product into a subterranean formation.

A sixteenth embodiment, which is the method of any of the fourteenth through fifteenth embodiments, further comprising:

providing a confining pressure to the sample cell; and providing an axial pressure to the sample cell.

A seventeenth embodiment, which is the method of the sixteenth embodiment, wherein providing a confining pressure comprises providing the confining pressure during the step of curing and providing the confining pressure during the step of testing, wherein the confining pressure during the step of curing is about equal to the confining pressure during the step of testing.

An eighteenth embodiment, which is the method of the sixteenth embodiment, wherein providing a confining pressure comprises providing a first confining pressure during the step of curing and providing a second confining pressure during the step of testing, wherein the first confining pressure is greater than the second confining pressure.

A nineteenth embodiment, which is the method of any of the fourteenth through eighteenth embodiments, wherein testing the stabilized sample comprises flowing a permeating fluid through the sample cell, applying an axial pressure upon the stabilized sample until failure thereof, or both.

A twentieth embodiment, which is the method of any of the fourteenth through nineteenth embodiments, further comprising:

flowing a flushing fluid from the first point external of the pressure cell, through the channel of the pressure cell, and to the second point external of the pressure cell.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. An apparatus for preparing and testing a sample of a subterranean formation, the apparatus comprising:

a pressure cell defining an interior volume, the pressure cell comprising:

a first end member comprising a channel formed therein;

a second end member;

a wall member positioned between the first end member and the second end member; and a sample cell positioned within the interior volume of the pressure cell;

wherein the channel of the first end member fluidly connects with a first point external of the pressure cell, with a second point external of the pressure cell, and with the sample cell.

2. The apparatus of claim 1, further comprising a piston at least partially received in the second end member, wherein the piston comprises a channel formed therein, wherein the channel of the piston fluidly connects with a third point external of the pressure cell, with a fourth point external of the pressure cell, and with the sample cell.

3. The apparatus of claim 1, wherein the second end member comprises a cylindrical space formed therein and a channel formed therein, wherein the channel of the second end member fluidly connects with a fifth point external of the pressure cell and with the cylindrical space.

4. The apparatus of claim 1, wherein the wall member comprises a first channel formed therein and a second channel formed therein, wherein the first channel of the wall member fluidly connects with the interior volume and with a sixth point external of the pressure cell, wherein the second channel of the wall member fluidly communicates with the interior volume and a seventh point external of the pressure cell.

5. The apparatus of claim 1, wherein the wall member and the sample cell define an annular space therebetween.

6. The apparatus of claim 1, wherein the first end member further comprises a groove which receives an end of the sample cell.

7. The apparatus of claim 1, further comprising a ring member positioned between the second end member and the sample cell.

8. The apparatus of claim 1, wherein the sample cell comprises a tubular sleeve positioned between the first end member and the second end member of the pressure cell.

9. The apparatus of claim 1, wherein the pressure cell further comprises an aperture formed in the second end member and in the wall member.

10. A system for preparing and testing a subterranean sample, the system comprising:

an apparatus comprising:

a pressure cell defining an interior volume, wherein the pressure cell comprises a channel formed therein; and a sample cell positioned within the interior volume of the pressure cell, wherein the channel of the pressure cell fluidly communicates with a first point external of the pressure cell, with a second point external of the pressure cell, and with the sample cell;

a sample of a subterranean formation placed within the sample cell; and a resin placed within the sample cell.

11. The system of claim 10, wherein the apparatus further comprises a piston comprising a channel formed therein, wherein the channel of the piston fluidly communicates with a third point external of the pressure cell, with a fourth point external of the pressure cell, and with the sample cell.

12. The system of claim 10, wherein the resin is placed within the sample cell via the channel of the pressure cell.

13. The system of claim 10, wherein the pressure cell and the sample cell define an annular space therebetween.

14. A method comprising:

providing an apparatus comprising a pressure cell defining an interior volume, and a sample cell positioned within the interior volume of the pressure cell, wherein the pressure cell comprises a channel formed therein, wherein the channel of the pressure cell fluidly communicates with a first point external of the pressure cell, with a second point external of the pressure cell, and with the sample cell;

loading a sample of a subterranean formation into the sample cell;

providing a stabilizing product;

flowing a sample of the stabilizing product into the sample cell via the channel formed in the pressure cell;

curing the stabilizing product in-situ of the sample cell; and testing the stabilized sample in-situ of the sample cell.

15. The method of claim 14, further comprising:

placing the stabilizing product into a subterranean formation.

16. The method of claim 14, further comprising:

providing a confining pressure to the sample cell; and providing an axial pressure to the sample cell.

17. The method of claim 16, wherein providing a confining pressure comprises providing the confining pressure during the step of curing and providing the confining pressure during the step of testing, wherein the confining pressure during the step of curing is about equal to the confining pressure during the step of testing.

18. The method of claim 16, wherein providing a confining pressure comprises providing a first confining pressure during the step of curing and providing a second confining pressure during the step of testing, wherein the first confining pressure is greater than the second confining pressure.

19. The method of claim 14, wherein testing the stabilized sample comprises flowing a permeating fluid through the sample cell, applying an axial pressure upon the stabilized sample until failure thereof, or both.

20. The method of claim 14, further comprising:

flowing a flushing fluid from the first point external of the pressure cell, through the channel of the pressure cell, and to the second point external of the pressure cell.

* * * * *